US008910584B2

(12) United States Patent
Bengtzen

(10) Patent No.: US 8,910,584 B2
(45) Date of Patent: Dec. 16, 2014

(54) STORAGE UNIT THAT CONVERTS INTO A BOAT

(76) Inventor: Troy Bengtzen, Holladay, UT (US)

( * ) Notice: Subject to any disclaimer, the term of this patent is extended or adjusted under 35 U.S.C. 154(b) by 192 days.

(21) Appl. No.: 13/545,911

(22) Filed: Jul. 10, 2012

(65) Prior Publication Data

US 2013/0015082 A1 Jan. 17, 2013

Related U.S. Application Data

(60) Provisional application No. 61/507,978, filed on Jul. 14, 2011.

(51) Int. Cl.

| | |
|---|---|
| ***B63B 21/64*** | (2006.01) |
| ***B63B 7/04*** | (2006.01) |
| ***A45C 9/00*** | (2006.01) |
| *A45C 5/14* | (2006.01) |
| *A45C 5/03* | (2006.01) |
| *B63C 9/02* | (2006.01) |
| *B63C 13/00* | (2006.01) |
| *B63C 15/00* | (2006.01) |
| *B63B 7/00* | (2006.01) |

(52) U.S. Cl.

CPC ... *B63B 7/04* (2013.01); *A45C 9/00* (2013.01); *A45C 5/14* (2013.01); *A45C 2005/037* (2013.01); *A45C 2009/005* (2013.01); *B63C 9/02* (2013.01); *B63C 13/00* (2013.01); *B63C 15/00* (2013.01); *B63B 2007/006* (2013.01)

USPC ..... 114/344; 114/353

(58) Field of Classification Search

USPC ..... 114/344, 352, 353, 354

IPC ..... B63B 7/04,2007/003

See application file for complete search history.

(56) References Cited

U.S. PATENT DOCUMENTS

| | | | | |
|---|---|---|---|---|
| 5,353,733 | A * | 10/1994 | Evans | 114/353 |
| 6,662,743 | B1 * | 12/2003 | Rolfe | 114/344 |
| 2001/0029880 | A1 * | 10/2001 | McCarthy | 114/353 |

* cited by examiner

*Primary Examiner* — Stephen Avila

(74) *Attorney, Agent, or Firm* — Michael F. Krieger; Kirton McConkie

(57) ABSTRACT

The present invention is directed to a storage unit that converts into a boat. The storage unit can store emergency or other supplies as well as components for quickly converting the storage unit into a boat. The compact design of the storage unit allows it to be stored in many different locations including inside or outside a home, business, institution, church, or other buildings, and above or below ground such as on a deck or patio, in a shed, garage, or basement, etc. where it can be quickly accessed and converted into the boat. The storage unit is further convertible into a cart using the components for converting the storage unit into the boat.

9 Claims, 9 Drawing Sheets

STORAGE UNIT THAT CONVERTS INTO A BOAT

CROSS-REFERENCE TO RELATED APPLICATIONS

This application claims priority to U.S. Provisional Patent Application No. 61/507,978, titled Mobile Adaptable Survival Container, which was filed on Jul. 14, 2011.

BACKGROUND

When a disaster, such as a flood, occurs, victims may be forced to evacuate an area over water. In such disasters, victims may also need to traverse water to obtain or transport aid or supplies. In most cases, traversing water is much easier using a boat. However, in emergency situations, an adequate boat will often not be accessible. For example, most people do not have adequate space to store a boat, or even if they do, they do not want to store a typical boat in or near their home. Also, although an inflatable raft can be more easily stored, such rafts cannot always be quickly inflated.

Additionally, in an emergency situation, it is desirable to have easy access to certain emergency supplies. Storing such emergency supplies with or near a boat is preferable in most scenarios especially when the emergency situation requires a water evacuation.

BRIEF SUMMARY

The present invention is directed to a storage unit that converts into a boat. The storage unit can store emergency supplies as well as components for quickly converting the storage unit into a boat. The compact design of the storage unit allows it to be stored in many different locations including inside or outside the home, business, institution, church, or other buildings, and above or below ground such as on a deck or patio, in a shed, garage, or basement, etc. The storage unit can be quickly accessed in these locations and converted into the boat such as when an emergency occurs. The storage unit, including the various devices it converts into, can also be used for recreational purposes. The storage unit is further convertible into a cart using the components for converting the storage unit into the boat.

In a first embodiment, a storage unit that converts into a boat comprises a first and a second shell that are each sized to enable the shells to be coupled together to form a storage unit. The storage unit further includes a first and a second pole for connecting together each of the shells to configure the shells as a boat.

In a second embodiment, a storage unit that converts into a boat comprises two equally sized shells that can be coupled together in a first configuration to form a storage unit, and in a second configuration to form a boat. In the first configuration, the shells are coupled together in an inverted position using a plurality of pins. In the second configuration, the shells are coupled together in a lateral position using a plurality of poles that are secured to each of the shells using the plurality of pins.

In a third embodiment, a storage unit that converts into a boat comprises two shells. Each shell has a lip that extends along the top edge which is used to connect the two shells together in a first configuration to form the storage unit, and in a second configuration to the form the boat. In the first configuration, the lips of the shells are aligned and secured together. In the second configuration, a first pole is connected to the lip along the front of each of the shells, and a second pole is connected to the lip along the back of each of the shells to secure the two shells together to form the boat.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a storage unit that converts into a boat. The storage unit can store emergency supplies as well as components for quickly converting the storage unit into a boat. The compact design of the storage unit allows it to be stored in many different locations including inside or outside the home, business, institution, church, or other buildings, and above or below ground such as on a deck or patio, in a shed, garage, or basement, etc. The storage unit can be quickly accessed in these locations and converted into the boat such as when an emergency occurs. The storage unit, including the various devices it converts into, can also be used for recreational purposes. The storage unit is further convertible into a cart using the components for converting the storage unit into the boat.

In a first embodiment, a storage unit that converts into a boat comprises a first and a second shell that are each sized to enable the shells to be coupled together to form a storage unit.

The storage unit further includes a first and a second pole for connecting together each of the shells to configure the shells as a boat.

In a second embodiment, a storage unit that converts into a boat comprises two equally sized shells that can be coupled together in a first configuration to form a storage unit, and in a second configuration to form a boat. In the first configuration, the shells are coupled together in an inverted position using a plurality of pins. In the second configuration, the shells are coupled together in a lateral position using a plurality of poles that are secured to each of the shells using the plurality of pins.

In a third embodiment, a storage unit that converts into a boat comprises two shells. Each shell has a lip that extends along the top edge which is used to connect the two shells together in a first configuration to form the storage unit, and in a second configuration to the form the boat. In the first configuration, the lips of the shells are aligned and secured together. In the second configuration, a first pole is connected to the lip along the front of each of the shells, and a second pole is connected to the lip along the back of each of the shells to secure the two shells together to form the boat.

Figure 1:
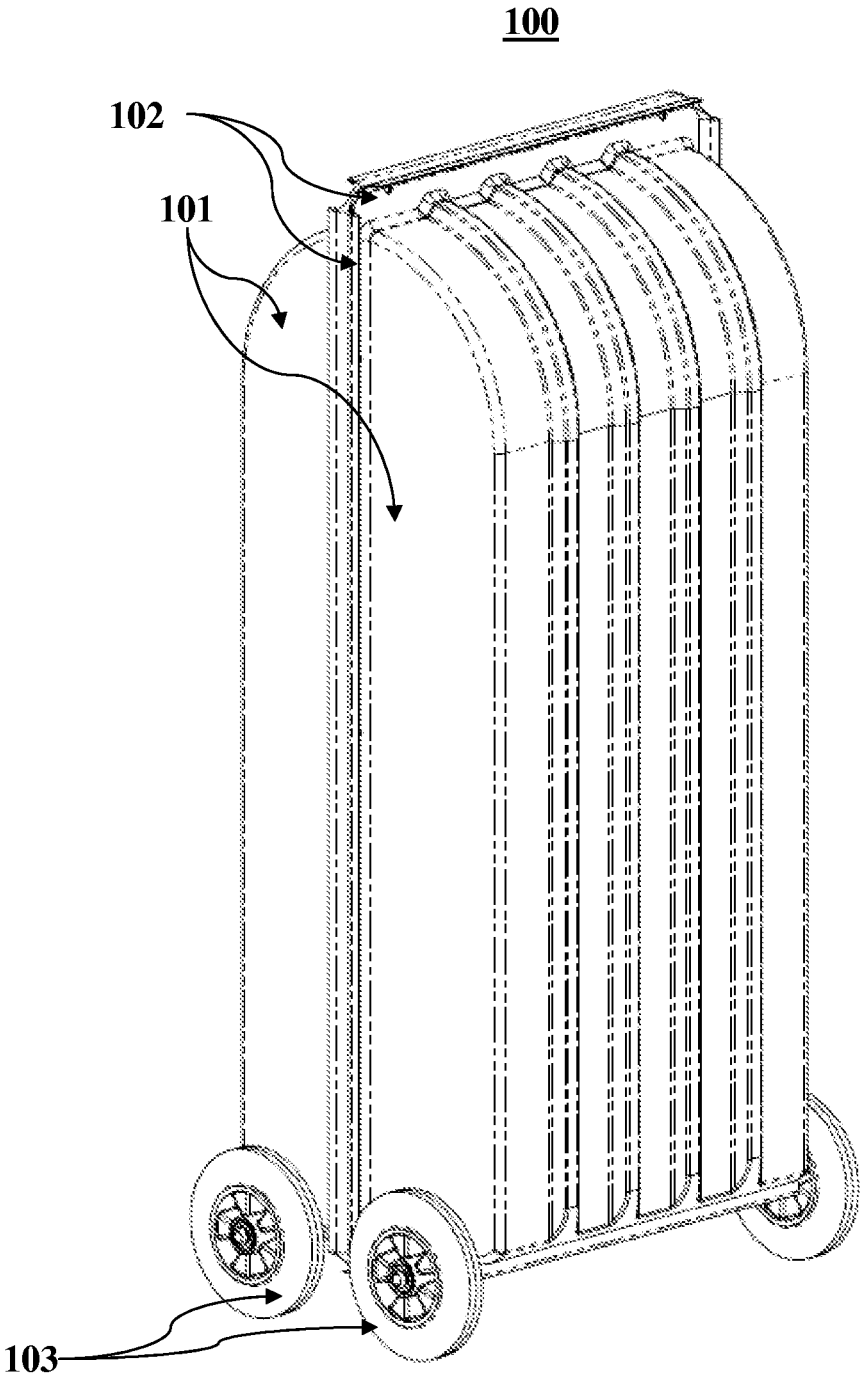
FIG. 1 illustrates a storage unit in an upright configuration that is convertible into a boat or cart.

FIG. 1 illustrates an exemplary storage unit 100 that converts into a boat according to one or more embodiments of the invention. Storage unit 100 comprises two shells 101 that can be joined together in the manner shown in FIG. 1. Storage unit 100 can be used to store emergency or other supplies as well as components for converting storage unit 100 into a boat. Shell 101 can be made of plastic (e.g. polyethylene), metal, composites, or any other suitable material. In some embodiments, the materials used for shell 101 can be resistant to the elements, including UV rays and extreme ranges of heat and cold, as well as extreme forces. Shell 101 can also be manufactured with a reflective coating to increase its visibility. In some embodiments, storage unit 100 can include (e.g. have embedded or be connected to) one or more digital electronic devices such as intermediate frequency receiver chips, global position system devices, emergency radio receivers, etc.

Although FIG. 1 illustrates shell 101 as having a sled shape, shells of other concave shapes can also be used. In some embodiments, each of shells 101 can be identically configured (i.e. in shape and size). In some embodiments, shells 101 can be configured to allow multiple shells 101 to be stacked on top of each other individually, or to facilitate the stacking of multiple storage units 100. Storage unit 100 can also include one or more instructions, diagrams, or photographs attached thereto which describe how to use each feature of storage unit 100 (e.g. how to convert storage unit 100 into boat 200).

In some embodiments, one or more of shells 101 can include connection points, such as holes, grommets, rivets, cutouts, pins, bars, inserts, etc. to which straps, ropes, handles, harnesses, chains, webbing, etc. can be connected to assist with transporting storage unit 100. Such connection points can also be used to store storage unit 100. For example, the connection points can be used to mount storage unit 100 under an eave of a house, business, institution, church, or other buildings, under the ceiling of a garage, on the side of a shed, along the rail of a ship, on the top of a car, etc.

Shell 101 further includes a lip 102 along the top edge of the shell. Lip 102 comprises a curved protrusion of shell 101 along the top edge as is shown in FIG. 1. Lip 102 can be formed along all of the sides of shell 101 as shown in FIG. 1, or alternatively, could be formed along only two opposing sides of shell 101.

Lip 102 is configured to allow each of the shells 101 to be coupled together by inverting one shell together with another shell so that lips 102 are aligned. To secure shells 101 together in this configuration, various connectors can be used. In one embodiment, lip 102 on each shell 101 can include a plurality of holes. The holes on one shell 101 can align with the holes on another shell 101 when the lips of the shells are aligned to allow pins (or any other appropriate type of connector) to be inserted through the aligned holes to secure the two shells together. In some embodiments, one or more connectors can be used to lock shells 101 together. Storage unit 100 can also be locked to a structure (e.g. via the holes in lip 102).

In some embodiments, lip 102 can be configured to provide a water tight seal when two shells 101 are joined together as shown in FIG. 1. For example, one or both of shells 101 can be formed as or include a gasket or other type of seal along lip 102 to provide a seal between lips 102 when shells 101 are joined. Each shell 101 can also include a pair of wheels 103 to facilitate transporting storage unit 100.

In the specification, pins are described as being used for various purposes. It is to be understood however that other types of connectors can equally be used. In general, any type of connector that can be inserted into or through holes to secure together two or more components may be used whenever reference is made to a pin.

Storage unit 100 can store various supplies that can be used in an emergency or any other type of situation. For example, storage unit 100 could store a 72 hour kit, other emergency supplies, or other types of supplies. Storage unit 100 also stores poles that are used to convert storage unit 100 into a boat as further described below, as well as other components for a boat such as life jackets and oars.

Figure 2:
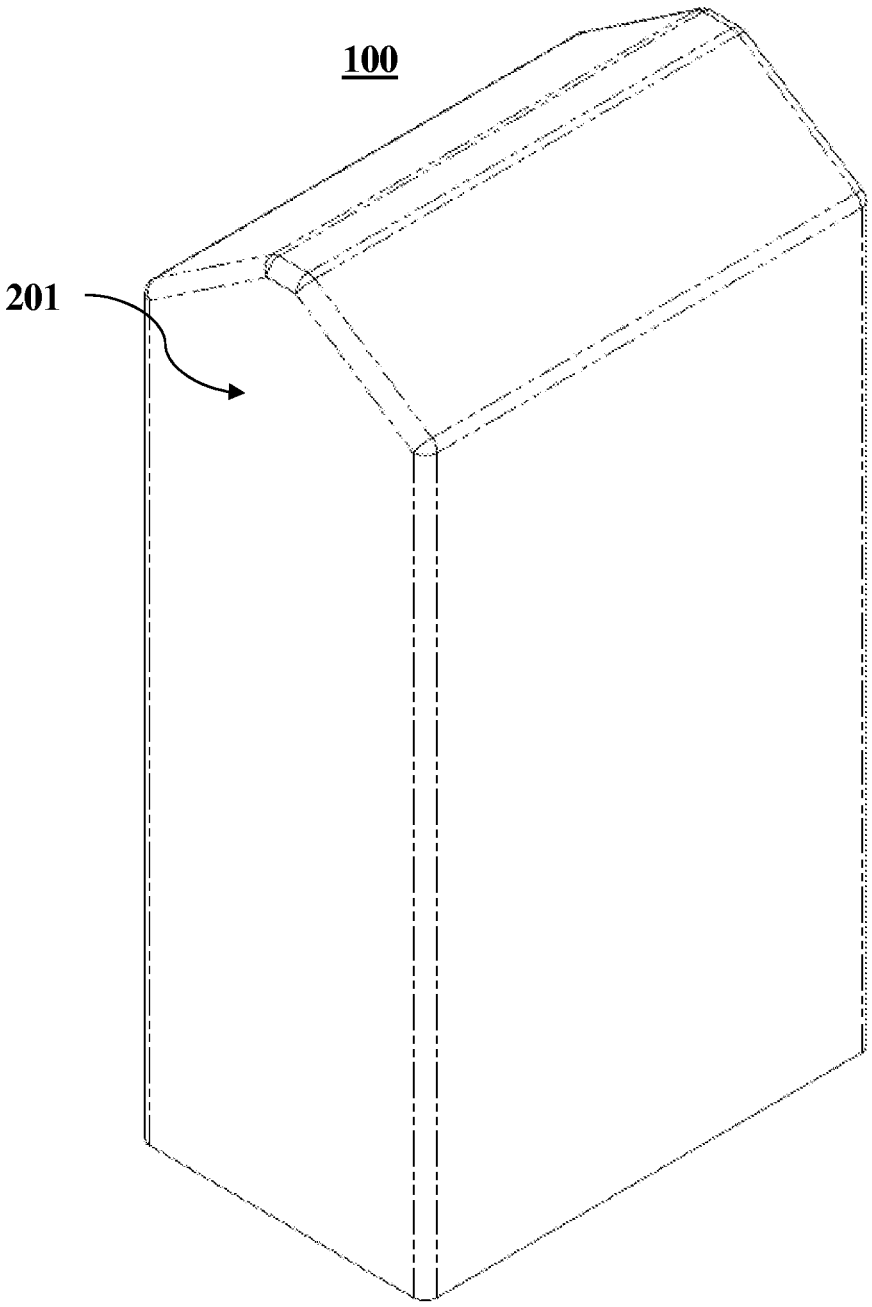
FIG. 2 illustrates the storage unit in an upright configuration with a cover.

FIG. 2 illustrates storage unit 100 in a vertical orientation with a cover 201. Cover 201 can be placed on storage unit 100 to improve the appearance of storage unit 100 when stored in visible locations, and to protect storage unit 100 from the negative effects of sunlight and weather. To provide maximum benefit, a boat should be placed in a quickly and easily accessible location. Such locations, however, are often highly visible such as a back porch or garage. Cover 201 can be used to make storage unit more aesthetically appealing to increase the likelihood that the storage unit will be stored in an accessible location.

Figure 3:
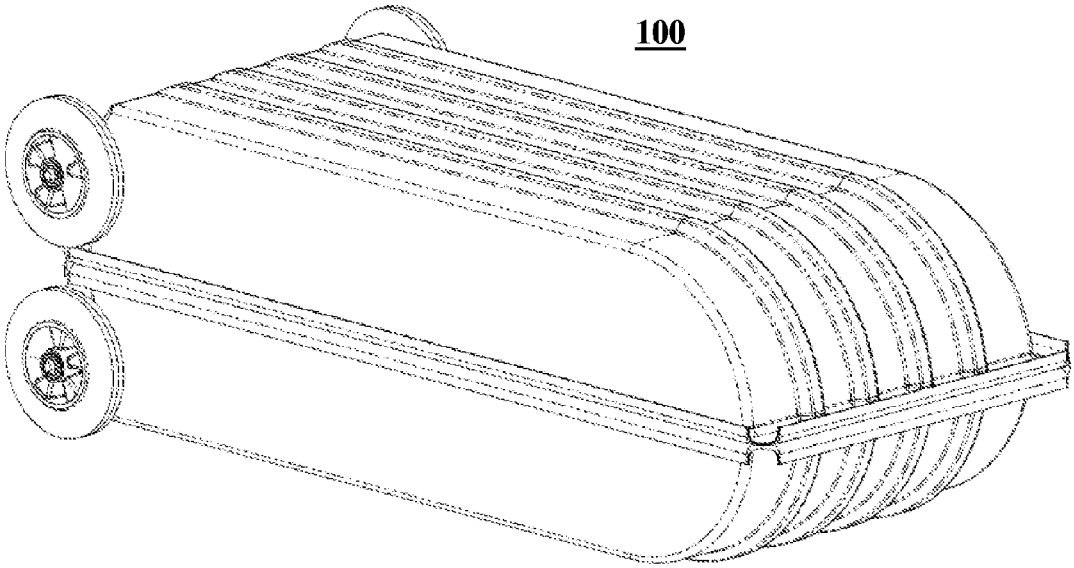
FIG. 3 illustrates the storage unit in a horizontal configuration.

FIGS. 1 and 2 also illustrate the relatively small footprint that storage unit 100 has when stored in an upright position. Because of this small footprint, storage unit 100 can be stored conveniently in many locations. FIG. 3 further illustrates that storage unit 100 can also be stored in a horizontal position.

Figure 4:
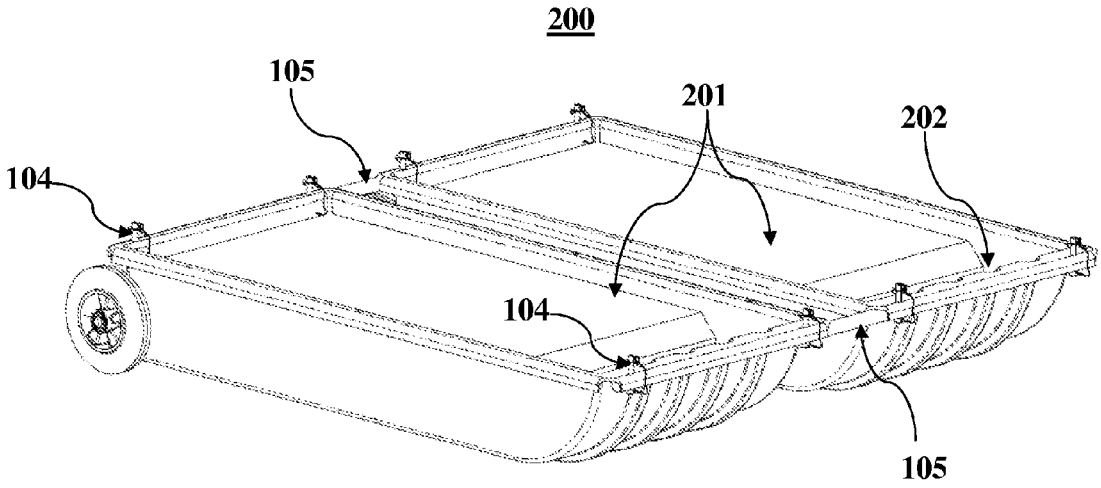
FIGS. 4-5 illustrate the storage unit when converted into the boat.

FIG. 4 illustrates storage unit 100 after it has been converted into boat 200. As shown, to form boat 200, shells 101 are positioned side-by-side, and poles 105 are connected between shells 101. In some embodiments, poles 105 are connected to each shell 101 using at least some of the same holes and pins used to connect the two shells together to form storage unit 100. In particular, the same pins and holes used to secure shells 101 together to form storage unit 100 can also be used to connect poles 105 between shells 101. FIG. 4 shows four pins 104 (only one of which is labeled on each end of boat 200) being used for each pole 105, although a different number of pins could also be used.

Figure 8:
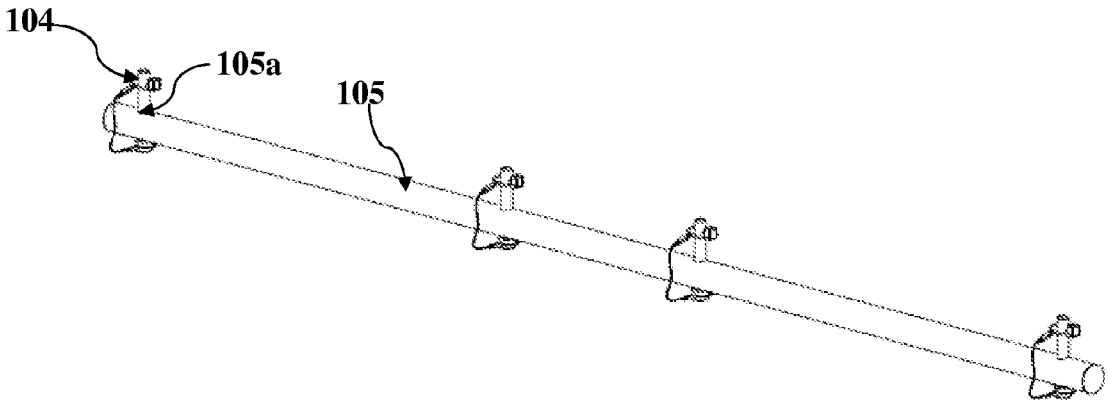
FIG. 8 illustrates an exemplary pole used to convert the storage unit into the boat and the cart.

As better shown in FIG. 8, each pole 105 can be configured with four holes 105*a* that align with the holes in the front and back portions of lip 102 such that two pins are used to secure pole 105 to each of the two shells 101. Of course, poles 105 could be configured with a different number of holes as necessary to match the holes in shells 101. Pins 104 can be of sufficient length to extend through lip 102 and pole 105 to secure pole 105 to lip 102. Of course, poles 105 can be connected to lip 102 using pins or connectors other than pins

104. However, configuring boat 200 to use the same pins 104 minimizes the number of additional components required to convert storage unit 100 into boat 200. This also provides the added benefit of minimizing the chance that the connectors necessary to form boat 200 could be lost and therefore unavailable when boat 200 is needed. Poles 105 can be configured to float such as by filling poles 105 with foam and sealing them.

Figure 5:
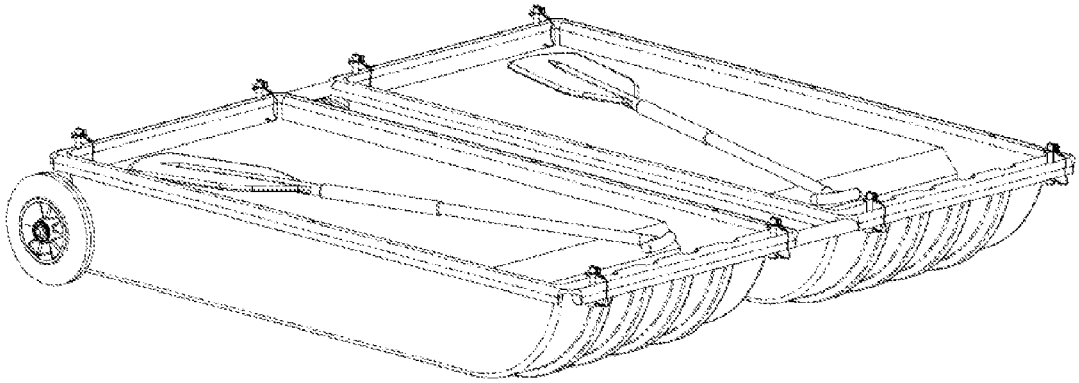

Each shell 101, as shown in FIGS. 4-7, includes a surface 201. Surface 201 serves two general functions. First, surface 201 can comprise buoyant material (e.g. foam) to increase the floating capacity of boat 200 (e.g. up to 1000 lbs.). Second, surface 201 provides a surface on which one or more persons or animals can sit when using boat 200. As shown in FIG. 4, surface 201 can be sized so that a cavity 202 is formed at one end of shell 101 (in FIG. 4, cavity 202 is formed at the front end of shell 101). Cavity 202 provides an area where emergency or other supplies can be stored. As shown in FIG. 5, supplies or components having a relatively flat profile (e.g. poles 105, oars, and life jackets) can also be stored on surface 201.

Accordingly, storage unit 100 can quickly be converted into boat 200 by removing pins 104 to separate each shell 101, removing poles 105 from shells 101, and connecting shells 101 together side-by-side using poles 105 and pins 104. With its compact design, storage unit 100 can be stored in virtually any location where it will be immediately accessible for quick conversion into boat 200. Further, because it can store a variety of supplies (e.g. for a family), storage unit 100 can serve as a single point of storage for such supplies.

Figure 6:
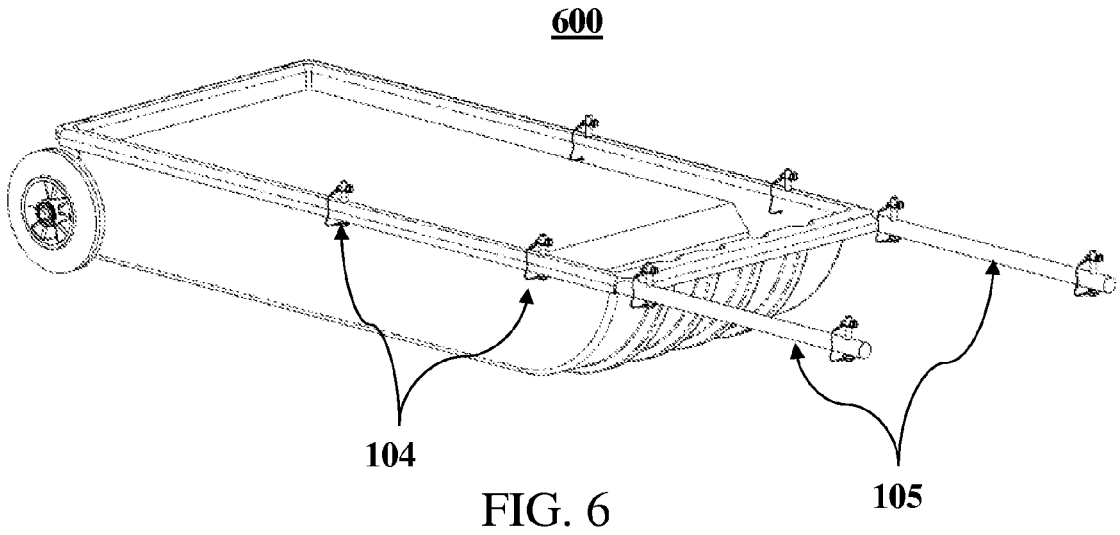
FIG. 6 illustrates the storage unit when converted into a cart.

FIG. 6 illustrates shell 101 when converted into a cart 600 using poles 105 and pins 104. As shown, poles 105 can be inserted under lip 102 on each side of shell 101 and attached to lip 102 using pins 104 to form handles. Cart 600 can be used similar to a wheel barrow. For example, if after using boat 200, it became necessary to transport supplies or a person on land, boat 200 could be converted into cart 600 for such transport.

Figure 7:
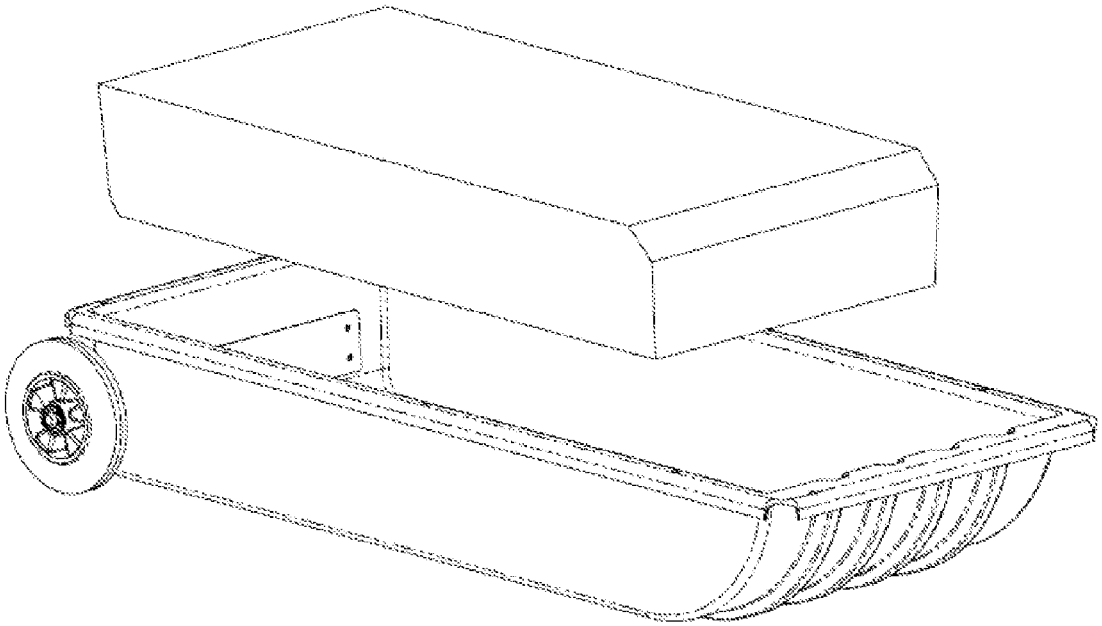
FIG. 7 illustrates the removable surface of the boat.
Figure 9:
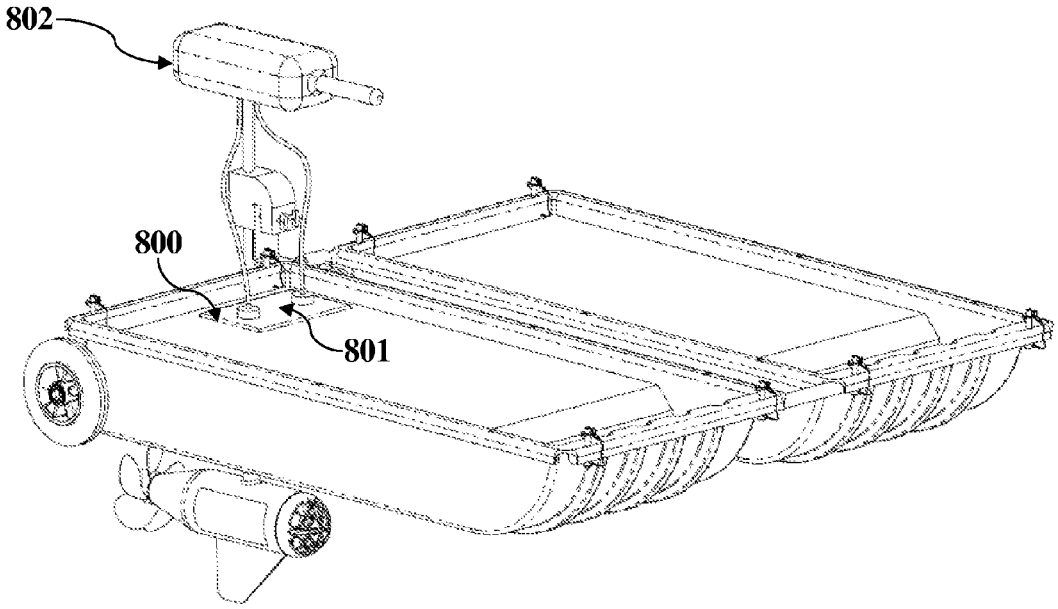
FIG. 9 illustrates the storage unit when converted into a boat that includes a motor.

FIG. 7 illustrates an exploded view of shell 101 and surface 201. Surface 201 is secured inside of shell 101 so as to not be easily removable as surface 201 provides buoyancy to shell 101. In some embodiments, boat 200 can be configured to allow the use of a motor. For example, as shown in FIG. 9, surface 201 can include an opening 800 in which a battery 801 can be placed for operating a motor 802. Motor 802 can be configured to attach to either or both of shells 101 or to pole 105. For example, in FIG. 9, motor 802 is shown as being attached to pole 105.

Storage unit 100 can also be used in non-emergency scenarios such as for recreational purposes. For example, because storage unit 100 can be easily transported, it can be carried to recreational areas and converted to boat 200 for recreational use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A storage unit that converts into a boat comprising:

two equally sized shells that can be coupled together in a first configuration to form a storage unit and in a second configuration to form a boat, each shell having a lip formed on a top edge of the shell along at least a front and a back of the shell, each shell including buoyant material disposed within the shell that provides a seating surface for the boat, each shell further including a pair of wheels positioned on the back of the shells to allow the shells to be wheeled in an upright position when the shells are coupled together as a storage unit;

wherein in the first configuration, the shells are coupled together in an inverted position using a plurality of pins, and in the second configuration, the shells are coupled together in a spaced apart and lateral position using a first and a second pole that are secured to each of the shells using the plurality of pins, the first pole being secured to the lip at the front of each of the shells and the second pole being secured to the lip at the back of each of the shells such that a portion of each of the first and second poles is positioned between the first and second shells and ends of the first and second poles are positioned under the lips when the shells are in the second configuration.

2. The storage unit of claim 1, wherein the first and second poles are positioned under the lips when connected to the lips.

3. The storage unit of claim 1, further comprising:

emergency or other supplies stored within the coupled shells.

4. The storage unit of claim 1, wherein the buoyant material in at least one of the shells includes an opening for housing a battery for powering a motor.

5. The storage unit of claim 1, wherein the buoyant material is sized to form a cavity at one end of the corresponding shell.

6. The storage unit of claim 1, wherein the plurality of poles are attachable to each of the at least one shell to form handles of a cart.

7. The storage unit of claim 6, wherein one or both of the shells includes lips along opposing sides of the shell, and wherein the plurality of poles are attachable to the lips along the opposing sides.

8. The storage unit of claim 1, wherein the shells are lockable together when in the first configuration, and the storage unit is lockable to a structure.

9. The storage unit of claim 1, wherein the poles are stored within the storage unit in the first configuration.

* * * * *